US008672256B2

(12) United States Patent
Tsurumi

(10) Patent No.: US 8,672,256 B2
(45) Date of Patent: Mar. 18, 2014

(54) PRINT SHEET SUPPLYING SHAFT DEVICE, SUPPLYING METHOD OF THE PRINT SHEET AND PRINTER FOR THE PRINT SHEET

(75) Inventor: Nanako Tsurumi, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 611 days.

(21) Appl. No.: 12/934,084

(22) PCT Filed: Aug. 26, 2009

(86) PCT No.: PCT/JP2009/004138

§ 371 (c)(1), (2), (4) Date: Sep. 23, 2010

(87) PCT Pub. No.: WO2011/013182

PCT Pub. Date: Feb. 3, 2011

(65) Prior Publication Data

US 2011/0168751 A1 Jul. 14, 2011

(30) Foreign Application Priority Data

Jul. 30, 2009 (JP) ..... 2009-177855

(51) Int. Cl.
*B65H 16/06* (2006.01)

(52) U.S. Cl.
USPC ..... 242/599.3; 242/598.3

(58) Field of Classification Search
USPC ..... 242/599, 599.3, 599.4, 598, 598.3
See application file for complete search history.

(56) References Cited

U.S. PATENT DOCUMENTS

| | | | | |
|---|---|---|---|---|
| 5,562,034 | A * | 10/1996 | Fox | 101/228 |
| 5,672,020 | A | 9/1997 | Leonard et al. | |
| 5,878,932 | A * | 3/1999 | Huang | 242/598.3 |
| 6,478,489 | B2 * | 11/2002 | Hierro | 242/422.4 |
| 7,287,718 | B2 * | 10/2007 | Cano et al. | 242/422.9 |
| 7,347,396 | B1 * | 3/2008 | Yu Chen | 242/599.3 |
| 8,272,422 | B2 * | 9/2012 | Gaines et al. | 242/599.3 |
| 2001/0052559 | A1 * | 12/2001 | Inana et al. | 242/598.3 |
| 2005/0230514 | A1 * | 10/2005 | Inana et al. | 242/599.3 |

FOREIGN PATENT DOCUMENTS

| | | |
|---|---|---|
| JP | 60-187153 | 12/1985 |
| JP | 50-77150 | 10/1993 |
| JP | 9-136744 A | 5/1997 |
| JP | 10-505554 A | 6/1998 |
| JP | 2006-159618 A | 6/2006 |

OTHER PUBLICATIONS

International Search Report dated Oct. 6, 2009, issued in corresponding international application No. PCT/JP2009/004138.

* cited by examiner

*Primary Examiner* — William A Rivera
(74) *Attorney, Agent, or Firm* — Ostrolenk Faber LLP

(57) ABSTRACT

A print sheet supplying shaft device and a supplying method of the print sheet and a printer for the print sheet which is capable of stably transferring the print sheet 5 along a transfer route, to be capable of maintaining the print position accuracy of the print sheet 5 at a predefined level.

A roll supply shaft (25) protrudes at outer surfaces of a roll holding member (22) holding the rolled print sheet (5). Constant friction force is applied to the surface of the roll supply shaft (25) by a shaft clamping member (23). An urging member (24) provides a load resisting the feeding movement of the print sheet (5) to the roll supply shaft (25) by urging the shaft clamping member (23) towards the roll supply shaft (25).

6 Claims, 8 Drawing Sheets

PRINT SHEET SUPPLYING SHAFT DEVICE, SUPPLYING METHOD OF THE PRINT SHEET AND PRINTER FOR THE PRINT SHEET

CROSS REFERENCE TO RELATED APPLICATION

The present application is a 35 U.S.C. §§371 national phase conversion of PCT/JP2009/004138 filed Aug. 26, 2009, which claims priority of Japanese Application No. 2009-177855, filed Jul. 30, 2009, the disclosure of which is incorporated by reference herein. The International Application was published in the Japanese Language.

TECHNICAL FIELD

The present invention relates to a print sheet supplying shaft device, a supplying method of the print sheet and a printer for the print sheet. More particularly, the present invention relates to a print sheet supplying shaft device, a supply method for the print sheet, and a printer for the print sheet for sending out a rolled print sheet in a strip-form along a sheet transfer route.

BACKGROUND ART

In the past, in a printer for sheet printing and for indicating all sorts of information on print sheets such as a strip-form continuous label and a tag, generally, the print sheet has been wound in a roll, loaded to a sheet supply unit inside the printer, and sent out in a strip form toward the printing unit along a transfer route from this sheet supplying unit.

Particularly, for example, in a case of using a strip-form continuous label, such as a nameplate label, as the print sheet for indicating the item stock number and specific information of various devices, the size of the label pieces (nameplates), a plurality of which are temporarily attached on the strip-form backing sheet, is often comparatively small, compared with other types of labels. Therefore, enabling accurate setting of the relative positions of the transferred continuous label strip (label pieces) with the sheet printing unit is necessary, particularly to ensure print position precision within a predefined range.

In other words, it is necessary to decrease backlash of the rolled print sheet as a rotating body at the sheet supplying unit or unstable rotation by inertia associated with the feeding along the transfer route and intermittent printing actions, thereby providing a predefined tension to the strip-form print sheet to prevent meandering on the transfer route, and also ensuring stability of the transfer to enable accurately obtaining the printing position on the print sheet at the sheet printing unit.

In order to apply the brake (resistance force at the upstream side of the sheet printing unit) and to provide a predefined tension to the rotating body at the sheet supplying unit, a configuration may be used pressing a friction plate with a predefined stress to the flat surface (shaft end surface) located at the side surface of the holding member holding the rotational body. For example, a disk brake may be used.

However, there is a problem that it is not possible to employ the above-mentioned configuration in case there is no flat surface to press the friction plate against on the holding member of the rotating body.

Furthermore, in case the shaft end surface of the holding member of the rotational body has some degree of freedom at the axial direction position, such as in a situation where the widths of the various print sheets are different, etc., there is a problem that it is difficult to apply a constant frictional force on the shaft end surface.

However, as mentioned above, depending on the type of the print sheet loaded at the sheet supplying unit, strict setting of the print position accuracy at the sheet printing unit must be feasible.

Furthermore, as a configuration with the sheet supplying unit provided at a corner portion of the printer is common, the loading operation of the rolled print sheet to the sheet supplying unit is complicated on many occasions. Therefore, there is a demand to simplify the supplying structure and the loading operation of the print sheet to the sheet supplying unit and to ensure the print position accuracy and the transfer stability of the printer.

SUMMARY OF INVENTION

Technical Problem

The present invention has been made in view of the aforementioned problem. The object of the present invention is to provide a print sheet supplying shaft device, a supplying method of the print sheet and a printer for the print sheet which are capable of accurately setting the relative position of the print sheet against the sheet printing unit.

Another object of the present invention is to provide a print sheet supplying shaft device, a supplying method of the print sheet and a printer for the print sheet which are capable of stably transferring the print sheet along the transfer route and capable of maintaining the printing accuracy or the printing position accuracy at a predefined level such that printing can be applied to labels that are relatively small in size such as nameplate labels, etc.

Another object of the present invention is to provide a print sheet supplying shaft device, a supplying method of the print sheet and a printer for the print sheet which are capable of providing a predefined level of tension to a print sheet by applying resistance (friction) to the holding portion of the print sheet (sheet supplying unit).

Another object of the present invention is to provide a print sheet supplying shaft device, a supplying method of the print sheet and a printer for the print sheet which are capable of decreasing backlash or rotation by inertia of the rotating body at the holding member of the print sheet (roll holding member).

Yet another object of the present invention is to provide a print sheet supplying shaft device, a supplying method of the print sheet and a printer for the print sheet which are capable of simplifying the configuration of the sheet supplying unit of the print sheet as much as possible and making the loading operation (attaching and detaching operation) of the print sheet to the sheet supplying unit simple and easy.

Solution to Problem

The present invention focuses on applying a constant frictional force to the outer circumferential surface of the roll supplying shaft by the shaft clamping members by protruding a roll supplying shaft respectively at a pair of right-and-left outer surfaces of the roll holding member holding the print sheet wound in a roll.

A first aspect of the present invention includes: a print sheet supplying shaft device which holds in a roll, at a sheet supplying unit, a strip-form print sheet for printing a predefined information at a sheet printing unit, and capable of feeding the print sheet in a strip-form to a transfer route headed toward the sheet printing unit, the print sheet supplying shaft device comprising: a roll holding member holding the print sheet in a roll and protruding a roll supplying shaft respectively at a pair of right-and-left outer surfaces; a shaft clamping member capable of clamping the roll supplying shaft in an attachable and detachable manner; an urging member (generally any kind of spring parts) urging the shaft clamping member towards the roll supplying shaft direction and capable of providing load to the roll supplying shaft resisting the feeding movement of the print sheet; and providing the shaft clamping member along the attaching and detaching direction of the print sheet to and from the sheet supplying unit.

A second aspect of the present invention relates to a method of supplying a print sheet by holding, at a sheet supplying unit, a strip-form print sheet for printing a predefined information in a roll at a sheet printing unit, and feeding the print sheet along a transfer route toward the sheet printing unit in a strip-form. The method of supplying a print sheet comprises: holding the print sheet in a roll at a roll holding member protruding a roll supplying shaft respectively at a pair of right-and-left outer surfaces; clamping the sheet roll supplying shaft in an attachable and detachable manner by a shaft clamping member provided along the attaching and detaching direction of the print sheet to and from the sheet supplying unit; urging the shaft clamping member in the roll supplying shaft direction by an urging member; and providing load to the roll supplying shaft resisting the feeding movement of the print sheet and feeding the print sheet to the transfer route.

A third aspect of the present invention relates to a printer for a print sheet having a printer main body, the printer main body having a sheet supplying unit which holds a strip-form print sheet in a roll for printing a predefined information at a sheet printing unit, and feeds the print sheet in a strip-form along a transfer route headed toward the sheet printing unit, and an openable cover connected to the printer main body at an opening and closing shaft on one end portion, the printer for the print sheet comprising: a roll holding member holding the print sheet in a roll and protruding a roll supplying shaft respectively at a pair of right-and-left outer surfaces at the sheet supplying unit; a shaft clamping member provided along the attaching and detaching direction of the print sheet to and from the sheet supplying unit, and capable of clamping the sheet roll supplying shaft in an attachable and detachable manner; and an urging member urging the shaft clamping member towards the roll supplying shaft direction and capable of providing load to the roll supplying shaft resisting the feeding movement of the print sheet; and by opening the openable cover from the printer main body, enabling to form a loading opening between the openable cover and the printer main body, and providing the shaft clamping member along the attaching and detaching direction from the loading opening to the sheet supplying unit of the rolled print sheet.

The above shaft clamping member has a supply shaft holding recess capable of clamping the roll supplying shaft rotatably.

The above shaft clamping member has a fixed clamping piece contacting the roll supplying shaft and supporting it; and a movable clamping piece clamping the roll supplying shaft between the movable clamping piece and the fixed clamping piece and openable and closable to the fixed clamping piece.

The roll holding member is provided with core holding plates capable of holding a winding core of the print sheet on inner surfaces opposite to the outer surfaces protruding the roll supplying shaft.

By opening the openable cover from the printer main body, it is possible to form a loading opening between the openable cover and the printer main body. Also, the shaft clamping member is capable of providing the shaft clamping member along the attaching and detaching direction from the loading opening to the sheet supplying unit of the rolled print sheet.

As the print sheet and as a continuous label configured with a plurality of label pieces applied with adhesive and temporarily attached to a strip-form backing sheet, a continuous price cut tag which does not have an adhesive layer may also be used.

Advantageous Effects of Invention

In a print sheet supplying shaft device, a supplying method of the print sheet and a printer for the print sheet of the present invention comprises providing a shaft clamping member which is capable of clamping the roll supplying shaft protruding respectively at a pair of right-and-left outer surfaces of the roll holding member holding the print sheet in a roll, and urging the shaft clamping member by an urging member towards the roll supplying shaft direction, enabling load to be provided to the roll supplying shaft for resisting the feeding movement of the print sheet and applying frictional force to the roll supplying shaft, it is capable of providing a tension of a predefined level when feeding the rolled print sheet in a strip-form and stably stretch the print sheet across the transfer route. Therefore, it is possible to achieve a stable supply of the print sheet, accurately ensuring relative positional relation of the print sheet at the sheet printing unit, and maintaining the print position accuracy within the range of a predefined level.

Furthermore, since the shaft clamping member is provided such that the outer circumferential portion of the roll supplying shaft is inserted and clamped, it is easy to deal with adjustment of the roll holding member according to the width of the print sheet or to a change of the shaft length of the roll supplying shaft.

In addition, since the shaft clamping member is provided along the attaching and detaching direction of the print sheet to and from the sheet supplying unit, the loading operation of the rolled print sheet can be done by only pushing the rolled print sheet towards the clamping member. Therefore the attaching and detaching of the rolled print sheet as a rotatable body is easy.

Particularly, according to the print sheet supplying shaft device of the first aspect of the invention, since it is provided with a roll holding member having a roll supplying shaft, a shaft clamping member clamping the roll supplying shaft, and an urging member urging the shaft clamping member, although the configuration is simple, it is possible to easily apply a resistance force of a predefined level which is necessary when feeding the print sheet.

Particularly, according to a method of supplying a print sheet of the second aspect of the invention, since the method includes clamping the sheet roll supplying shaft in an attachable and detachable manner, urging the shaft clamping member in the roll supplying shaft direction by an urging member, providing load to the roll supplying shaft resisting the feeding movement of the print sheet, and feeding the print sheet to the transfer route, it is possible to accurately set the relative positional relation of the sheet printing unit with the print sheet, ensuring the print position accuracy.

Particularly, according to the printer for print sheet of the third aspect of the invention, since the printer has a roll holding member, a shaft clamping member, and an urging member, and is capable of clamping the roll holding member to the shaft clamping member of the sheet supplying unit in a state that an openable cover is opened forming a loading opening, the loading operation of the rolled print sheet to the sheet supplying unit is easy and reliable, and it is possible to ensure stable transfer supply and print position accuracy.

DESCRIPTION OF EMBODIMENTS

According to the present invention, a roll holding member having a roll supplying shaft, a shaft clamping member clamping the roll supplying shaft, and an urging member urging the shaft clamping member are provided to achieve a print sheet supplying shaft device, a supplying method of the print sheet and a printer for the print sheet which provides a predefined resistance force at feeding of the print sheet, and which ensures stable transfer supply and printing position accuracy.

Embodiment

Figure 1:
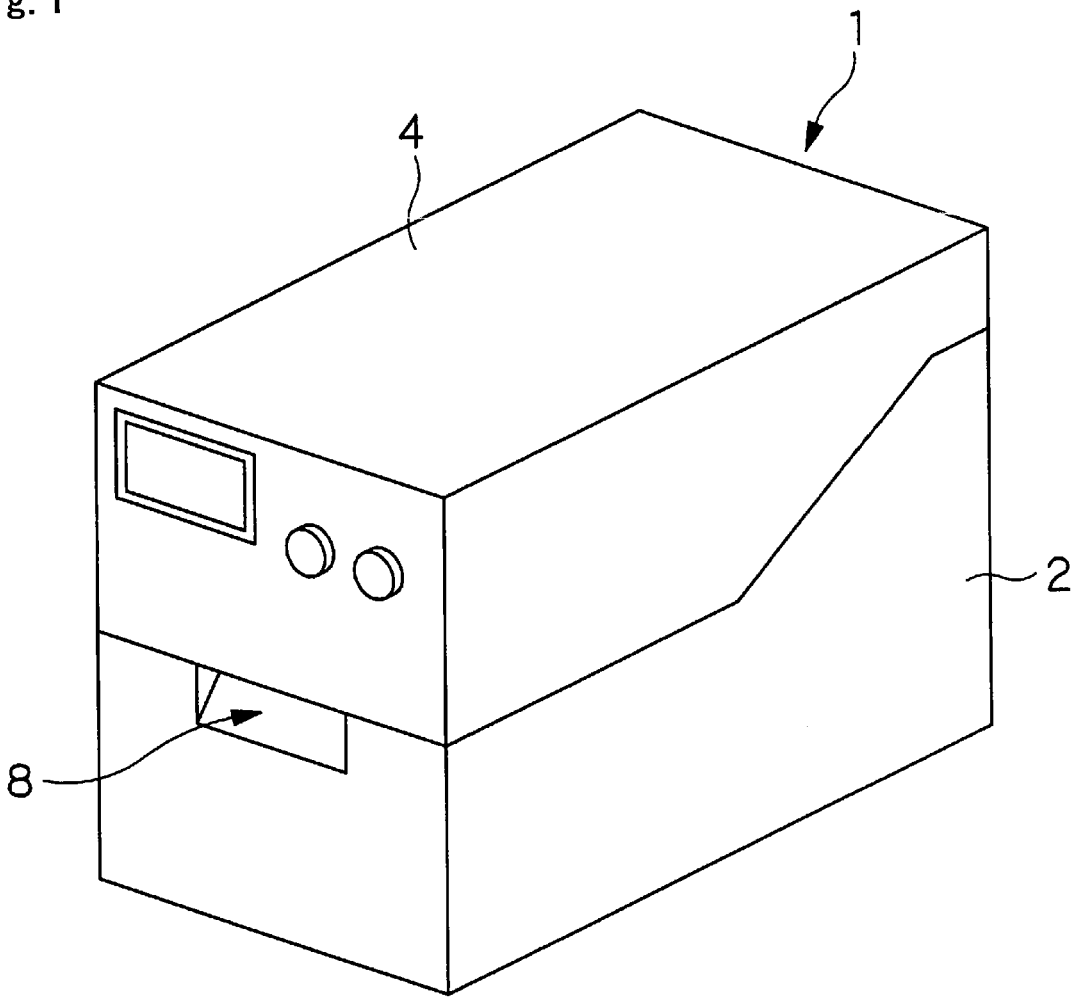
FIG. 1 is a perspective view diagram of the printer for print sheet 1 according to the embodiment of the present invention.

FIG. 1 is a perspective view diagram of the printer for print sheet 1. The printer for print sheet 1 has a printer main body 2, and an openable cover 4 which is connected to the printer main body 2 at one end side by an opening and closing shaft 3 (FIG. 2) and the cover opens and closes over the printer main body 2.

Figure 2:
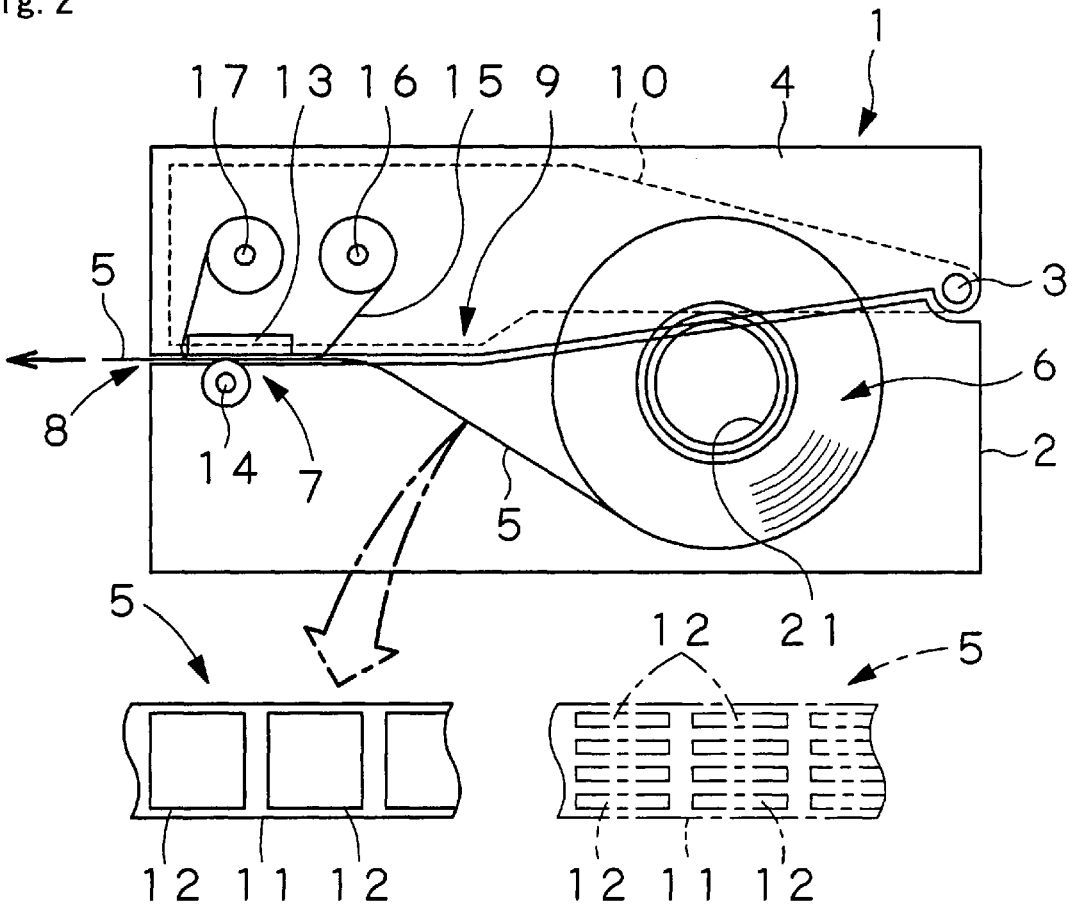
FIG. 2 is a schematic side view diagram of the printer for print sheet 1 with the openable cover 4 in a closed state.
Figure 3:
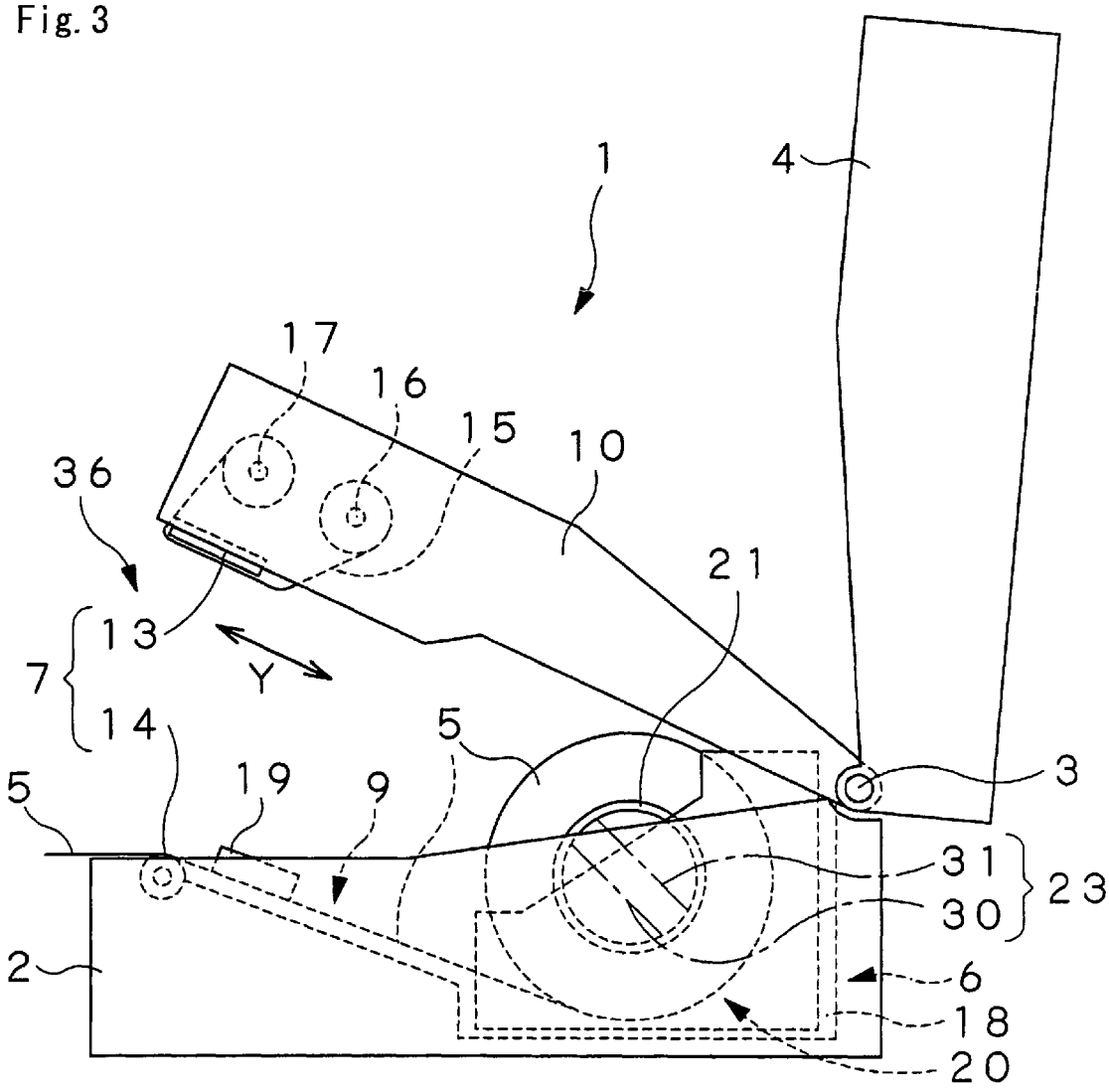
FIG. 3 is a schematic side view diagram of the printer for print sheet 1 with the openable cover 4 (and the openable bracket 10) in an opened state.

FIG. 2 is a schematic side view diagram of the printer for print sheet 1 with the openable cover 4 in a closed state. FIG. 3 is a schematic side view diagram of the printer for print sheet 1 with the openable cover 4 (and the openable bracket 10) in an opened state.

The printer main body 2 has a sheet supplying unit 6 of a print sheet 5 toward the opening and closing shaft 3, and a sheet printing unit 7 between the printer main body 2 and the openable cover 4 downstream side of the opening and closing shaft 3 in the sheet transferring direction. Starting at the sheet supplying unit 6 and extending to the sheet discharging outlet 8, at the downstream side of the opening and closing shaft 3 in the sheet transferring direction, via the sheet printing unit 7 is defined as a transfer route 9.

Between the openable cover 4 and the printer main body 2, an openable bracket 10 is openable and closable around the opening and closing shaft 3 in the same way as the openable cover 4.

Particularly, as enlarged and shown in FIGS. 2*a* and 2*b*, as a strip-form print sheet 5 (for example, a continuous label) for thereon printing of predefined information includes, a print sheet 5 configured with a plurality of label pieces 12 temporarily attached on a strip-form backing sheet 11.

In addition, as shown by the virtual line in FIG. 2*b*, small size label pieces 12 may be arranged in several rows on the backing sheet 11, for example to be used as nameplate labels.

The sheet printing unit 7 has a thermal head 13 provided at the openable bracket 10 side, a platen roller 14 provided at the printer main body 2 side, and a ribbon supplying shaft 16 and a ribbon take-up shaft 17 for a thermal transfer ribbon 15 provided at the openable bracket 10 side.

With opening and closing of the openable cover 4 and the openable bracket 10, the sheet printing unit 7 enables the thermal head 13 and the platen roller 14 to be attached to and detached from the other.

In addition, depending on the configuration of the sheet printing unit 7 or the openable cover 4, without providing an openable bracket 10, a part of the sheet printing unit 7 (the above mentioned thermal head 13, the ribbon supplying shaft 16 and the ribbon take-up shaft 17 of the thermal transfer ribbon 15, etc.) may be provided at the openable cover 4.

Particularly, as shown in FIG. 3, along the transfer route 9, a pair of right and left width regulating plates (upstream side width regulating plate 18) at the sheet supplying unit 6 and a pair of width regulating plates (downstream side width regulating plate 19) near the sheet printing unit 7 are provided respectively, which are respectively capable of position adjustment in the direction perpendicular to the transfer route 9 according to the widths of all sorts of print sheets 5.

At sheet supplying unit 6, a supplying shaft device 20 for the print sheet 5 according to an embodiment of the present invention is provided.

The supplying shaft device 20 of the print sheet 5 holds the print sheet 5 in a roll at the sheet supplying unit 6 on a winding core 21 and enables feeding it to the transfer route 9 heading from the sheet supplying unit 6 in a strip-form.

Figure 4:
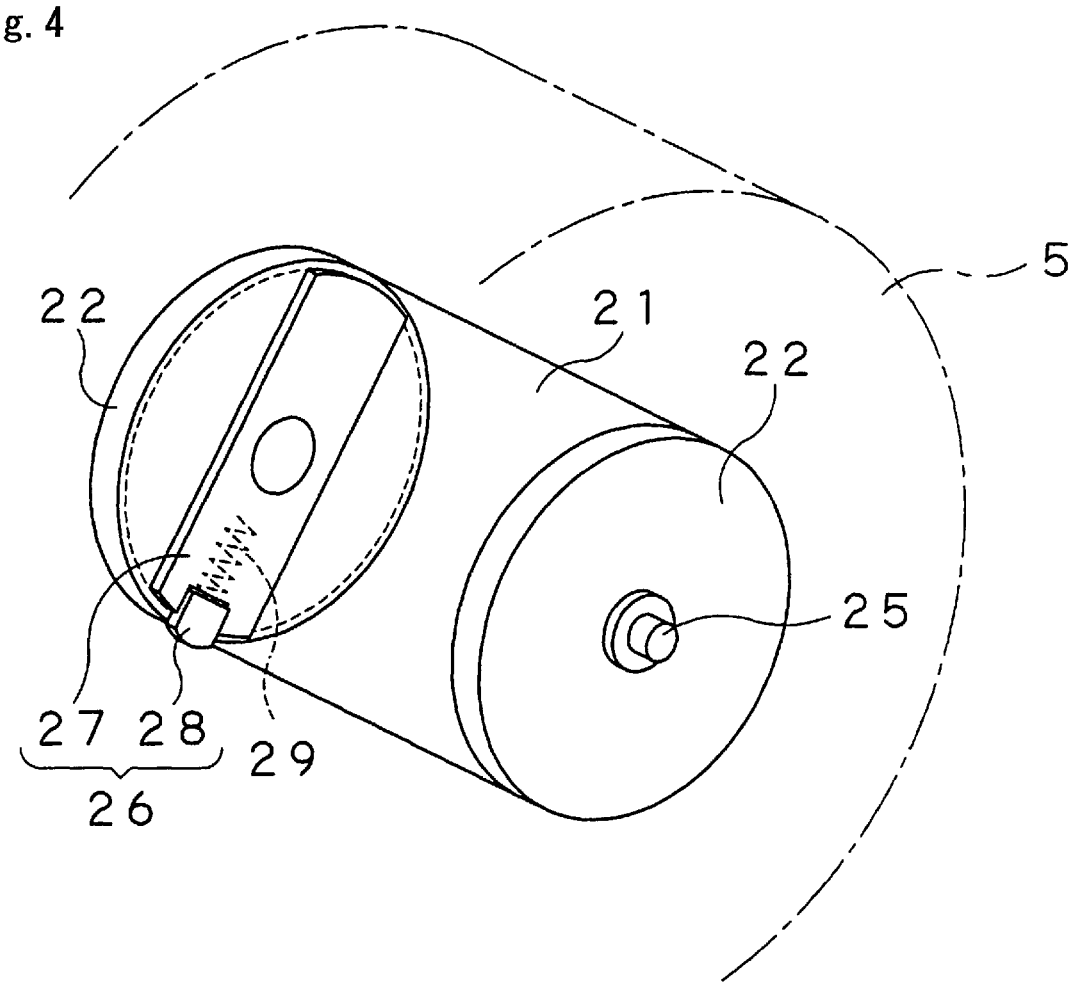
FIG. 4 is a perspective view diagram of a pair of right and left roll holding member 22 at the print sheet 5 supplying shaft device 20.
Figure 5:
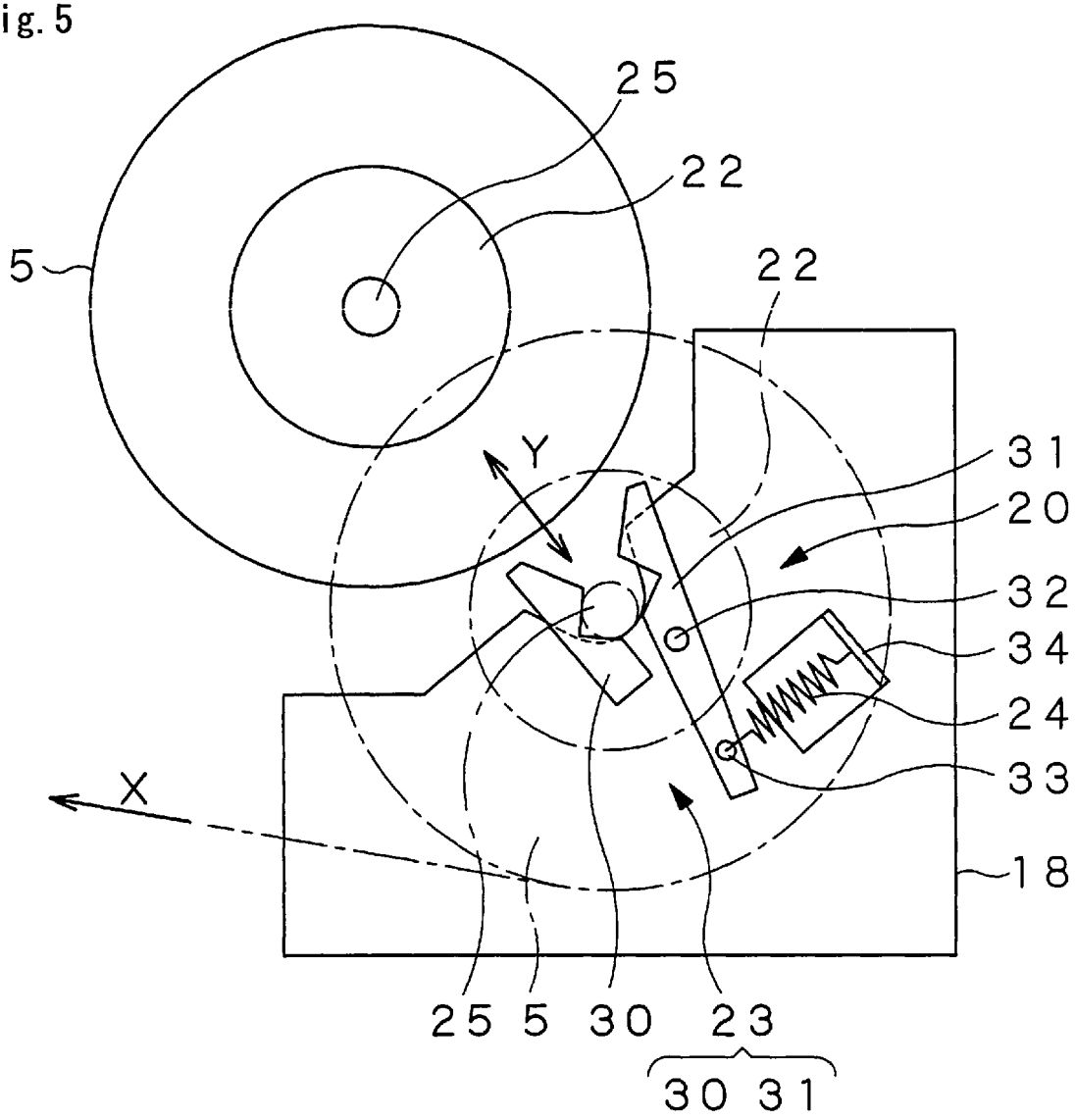
FIG. 5 is a schematic side view diagram of the print sheet 5 supplying shaft device 20 when loading the print sheet 5.
Figure 6:
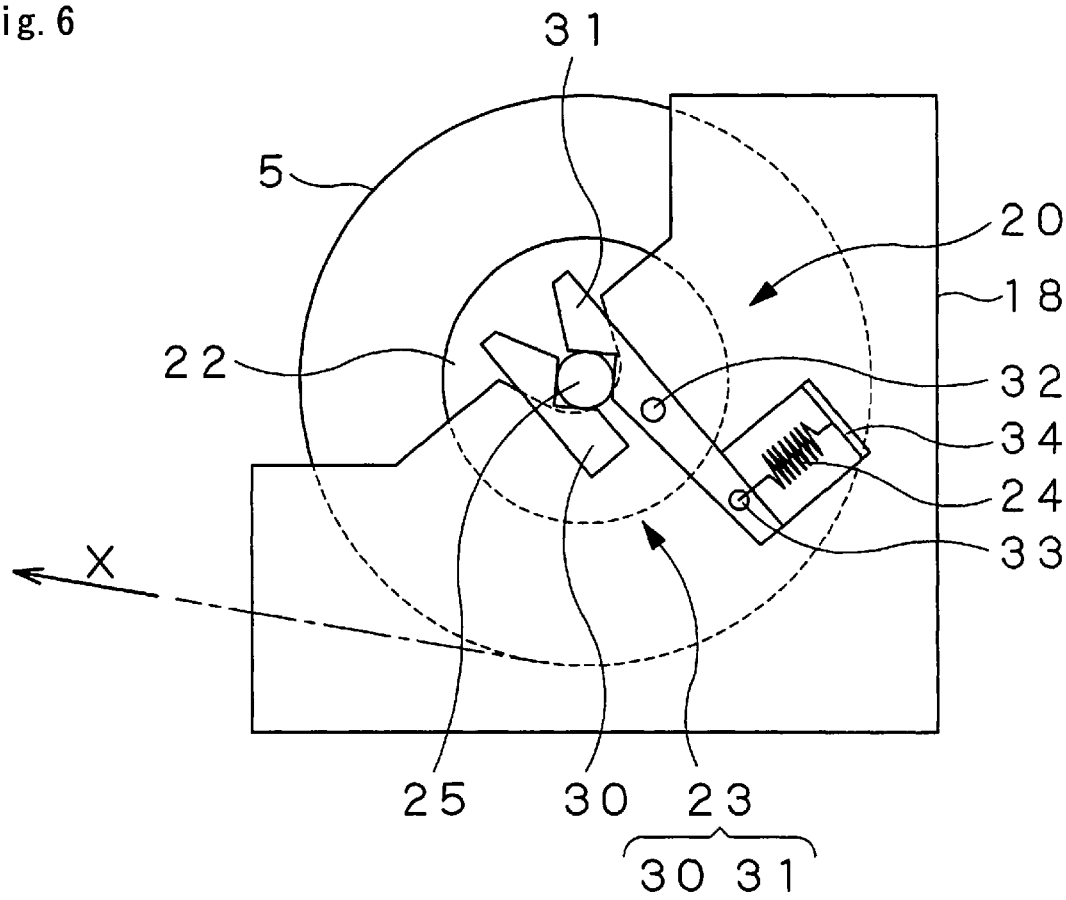
FIG. 6 is a schematic side view diagram of the print sheet 5 supplying shaft device 20 in a state loaded with the print sheet 5.
Figure 7:
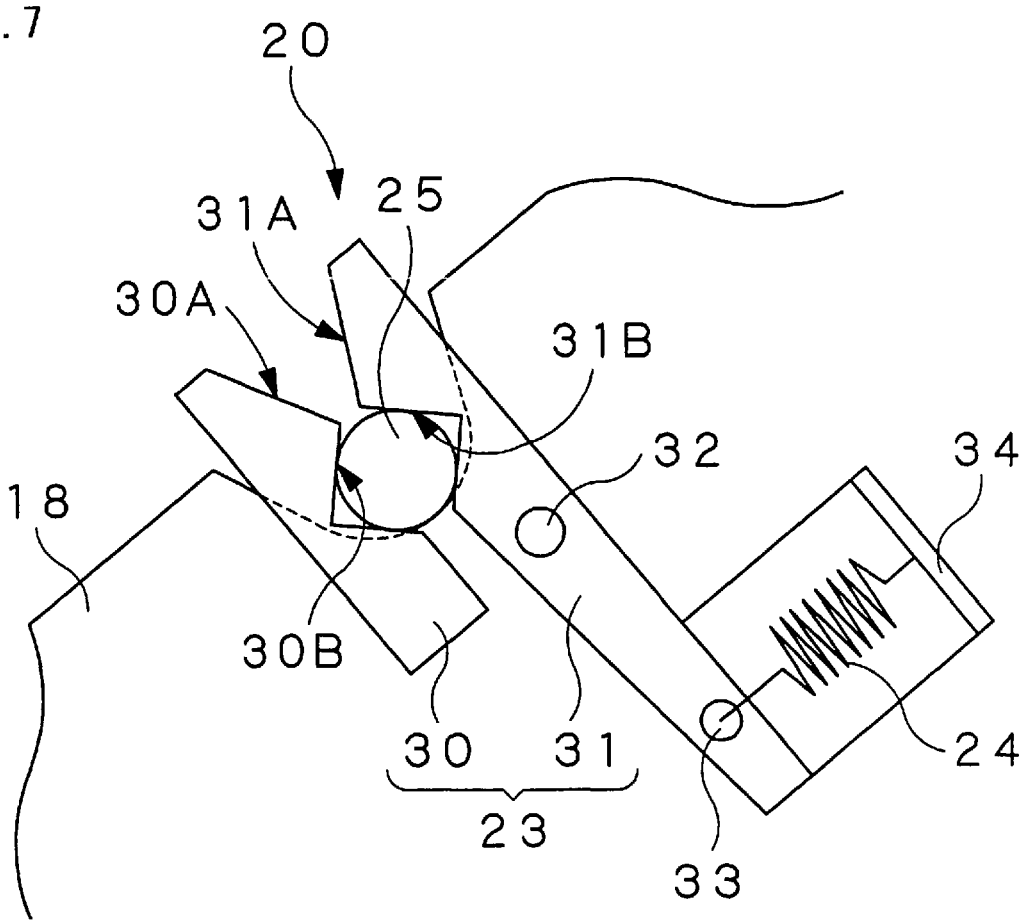
FIG. 7 is a side view diagram of the substantial part (shaft clamping member 23) of the print sheet 5 supplying shaft device 20.
Figure 8:
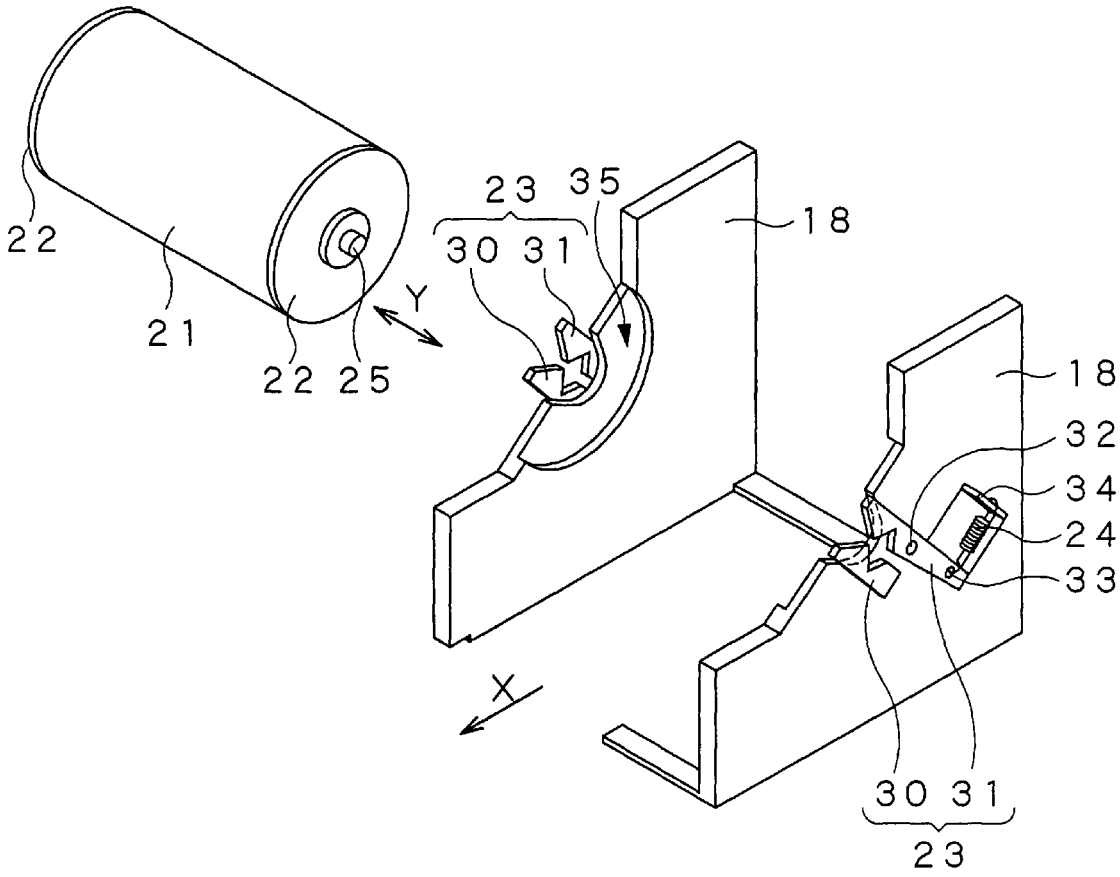
FIG. 8 is a perspective view diagram of the loading operation of the print sheet 5 to the print sheet 5 supplying shaft device 20.

FIG. 4 is a perspective view diagram of a pair of right and left roll holding member 22 at the print sheet 5 supplying shaft device 20. FIG. 5 is a schematic side view diagram of the print sheet 5 supplying shaft device 20 when loading print sheet 5. FIG. 6 is a schematic side view diagram of the print sheet 5 supplying shaft device 20 in a state loaded with the print sheet 5. FIG. 7 is a side view diagram of the substantial part (shaft clamping member 23) of the print sheet 5 supplying shaft device 20. FIG. 8 is a perspective view diagram of the loading operation of the print sheet 5 to the print sheet 5 supplying shaft device 20.

As shown in FIGS. 7 and 8, the supplying shaft device 20 for the print sheet 5 has the roll holding member 22, a pair of right and left shaft clamping member 23, and an urging member 24.

As shown in FIG. 4, the roll holding member 22 is holding the print sheet 5 in a roll, and a roll supplying shaft 25 protrudes respectively out to a pair of right and left outer surfaces.

At the inner surface side of the roll holding member 22 on the opposite side of the outer surface from which the roll supplying shaft 25 protrudes, there is a core holding plate 26 for holding and fixing the winding core 21 of the print sheet 5. The core holding plate 26 has a fixed holding plate 27 extending in the diametrical direction, and a movable holding plate 28 protruding out at its end portion.

The urging force of a compression spring 29 urges the movable holding plate 28 outwardly from the fixed holding plate 27. The movable holding plate 28 contacts the inner circumferential surface of the winding core 21 of the print sheet 5 with a predefined pressing force, and together with the fixed holding plate 27, this enables holding the print sheet 5 via the winding core 21.

As shown in FIGS. 5 through 8, the shaft clamping member 23 has a fixed clamping piece 30 and a movable clamping piece 31, and is capable of clamping on the outer circumferential surface in a manner for attaching and detaching the roll supplying shaft 25. In other words, the fixed clamping piece 30 is attached in a fixed manner to the upstream side width regulating plate 18, and is formed with an inclined surface 30A at its end portion. After the inclined surface 30A, there is a supplying shaft holding recess 30B which is in a V-shape in cross-section. The supplying shaft holding recess 30B contacts the roll supplying shaft 25 from the lower side supporting it rotatably.

The movable clamping piece 31 is attached in a rotatable manner around the rotating shaft 32 of the upstream side width regulating plate 18 in an openable and closable manner with respect to the fixed clamping piece 30, and is formed with an inclined surface 31A at its end portion. After the inclined surface 31A, there is a supplying shaft holding recess 31B, which is in a V-shape in cross-section. Between the supplying shaft holding recess 31B and the supplying shaft holding recess 30B of the fixed clamping piece 30, these clamp the roll supplying shaft 25 rotatably.

As shown in FIG. 7, the urging member 24, such as an extension spring set between the spring attaching plate 34 provided on the upstream side width regulating plate 18, and the spring attaching shaft 33 provided at an end portion side of the rotatable shaft 32 of the movable clamping piece 31, it is possible to rotatably urge the movable clamping piece 31 to the fixed clamping piece 30 direction, applying frictional force to the roll supplying shaft 25. In other words, the urging member 24 is capable of providing a load, resisting the feeding movement of the print sheet 5 towards the transfer route 9, to the roll supplying shaft 25 clamped between the roll supplying shaft 25 and the fixed clamping piece 30, by urging the movable clamping piece of the shaft clamping member 23 towards the roll supplying shaft 25.

As shown in FIG. 8, on the inner surface side of the upstream side width regulating plate 18 where the shaft clamping member 23 of the print sheet 5 supplying shaft device 20 is attached, a half-arc form attaching recess 35 is formed. It enables storing the roll holding member 22 of the print sheet 5 loaded at the supplying shaft device 20 rotatably in the feeding direction X.

Furthermore, the shaft clamping member 23 is provided in an inclined position towards the center portion of the attaching recess 35, with its length direction provided along the attaching and detaching direction Y to the sheet supplying unit 6 of the print sheet 5.

As shown in FIGS. 3 and 5, a loading opening 36 is formed between the openable bracket 10 and the printer main body 2, by opening the openable cover 4 and the openable bracket 10 from the printer main body 2.

The shaft clamping member 23 is provided along the attaching and detaching direction Y of the rolled print sheet 5, from the loading opening 36 to the sheet supplying unit 6, such that the inclined surface 30A of the fixed clamping piece 30 and the inclined surface 31A of the movable clamping piece 31 are opposing the roll supplying shaft 25 of the roll holing member 22.

Therefore, it is possible to ensure the brake force necessary in the feeding direction X of the print sheet 5 by the clamping effect of the urging member 24, and the fixed clamping piece 30 and the movable clamping piece 31. Also, in the attaching and detaching direction Y of the print sheet 5 (roll supplying shaft 25) at the shaft clamping member 23, the slopes of the inclined surfaces 30A, 31A and the supplying shaft holding recesses 30B, 31B, facilitate the attaching and detaching operation with a relatively weak resistance force.

The printer 1 for the print sheet, and the print sheet 5 supplying shaft device 20 configured in such a manner is capable of clamping the roll holding member 22 at the clamping member 23 of the sheet supplying unit 6, with the openable cover 4 and the openable bracket 10 in a opened state.

The printer 1 for the print sheet, and the print sheet 5 supplying shaft device 20 holds the print sheet 5 in a roll at a roll holding member 22 from which protrudes a roll supplying shaft 25 respectively at a pair of right-and-left outer surfaces, clamps the roll supplying shaft 25 by a pair of shaft clamping member 23, and urges the shaft clamping member 23 to the roll supplying shaft 25 direction by action of the urging member 24. It is possible to provide a load resisting the feeding movement of the print sheet 5 to the roll supplying shaft 25, and to feed the print sheet 5 in a strip-form to the transfer route 9.

When attaching and detaching the print sheet 5 to the sheet supplying unit 6 (supplying shaft device 20), only the pushing operation of the roll supplying shaft 25 of the roll holding member 22 obliquely downward towards the shaft clamping member 23 from the loading opening 36, or the pulling out operation of the roll supplying shaft 25 obliquely upward from the shaft clamping member 23 is required. Therefore, the attaching and detaching operations are simple.

Furthermore, loading print sheets 5 of different widths requires position adjustment of a pair of right and left width regulating board/plate (upstream side width regulating plate 18 and downstream side width regulating plate 19). However, only the position of the roll holding member 22 provided with the roll supplying shaft 25 is adjusted integrally with the upstream side width regulating plate 18. Therefore, even if the setting positions in the axial direction of the roll supplying shaft 25 are different by this adjustment, since the shaft clamping member 23 operates the clamping force towards the diametrical direction of the roll supplying shaft 25, it is possible to absorb the backlash both in the radial and axial directions when loading the print sheet 5 and to achieve a stable transfer of the print sheet 5.

In addition, it is possible to adjustably move the upstream side width regulating plate 18 in the width direction with the roll supplying shaft 25 in a clamped state by the shaft clamping member 23, and therefore possible to smoothly execute the loading operation of the print sheet 5 and the width adjusting operation of the upstream side width regulating plate 18.

Thus, on the print sheet 5 fed out in a strip-form, resistance by friction is provided at the roll supplying shaft 25 on the upstream side, and the print sheet 5 is transferred along the transfer route 9 while being provided with tension of a predefined level. Therefore, it is possible to maintain the relative position accuracy of the print sheet 5 against the thermal head 13 and the platen roller 14 of the sheet printing unit 7 within a predefined range, such that even if the size of the print sheet 5 is small, like a nameplate, it is possible to perform printing by stabilizing the transferring function, improving the print position accuracy. Since the attaching position of the shaft clamping member 23 is set facing the loading opening 36, the attaching and detaching operation of the print sheet is also simple and easy.

The invention claimed is:

1. A print sheet supplying shaft device comprising:

a main body;

a roll of a strip-form print sheet for printing a predefined information on the print sheet at a sheet printing unit;

a sheet supplying unit capable of feeding the print sheet in a strip-form along a transfer route headed toward the sheet printing unit, a roll holding member holding the print sheet in the roll, the roll holding member having a pair of right and left outer surfaces;

a roll supplying shaft protruding respectively at the pair of right and left outer surfaces;

a shaft clamping member configured for clamping the roll supplying shaft in an attachable and detachable manner residing on a regulating plate within the main body;

an urging member urging the shaft clamping member towards clamping the roll supplying shaft and also causing the urging member to provide load to the roll supplying shaft for resisting the feeding movement of the print sheet; and the shaft clamping member positioned along the attaching and detaching direction of the print sheet to and from the sheet supplying unit.

2. The print sheet supplying shaft device according to claim 1, wherein the shaft clamping member includes a supplying shaft holding recess shaped and configured for clamping the roll supplying shaft rotatably.

3. The print sheet supplying shaft device according to claim 1, wherein the shaft clamping member includes:

a fixed clamping piece fixed to the regulating plate and contacting the roll supplying shaft for supporting it; and a movable clamping piece residing on the regulating plate and clamping the roll supplying shaft between the movable clamping piece and the fixed clamping piece, and the movable clamping piece is openable and closable to the fixed clamping piece.

4. The print sheet supplying shaft device according to claim 3, wherein the roll holding member includes core holding plates configured for holding a winding core of the print sheet on inner surfaces opposite the outer surfaces at which the roll supplying shaft protrudes.

5. A method of supplying a print sheet comprising providing a printer main body;

providing a plate within the printer main body;

holding a strip-form print sheet at a sheet supplying unit wherein the sheet is for subsequently printing a predefined information in a roll at a sheet printing unit, holding the print sheet in a roll at a roll holding member from which a roll supplying shaft protrudes respectively outward of a pair of right-and-left outer surfaces;

clamping the sheet roll supplying shaft in an attachable and detachable manner by a shaft clamping member provided on the plate within the printer main body along the attaching and detaching directions of the print sheet which directions are to and from the sheet supplying unit;

urging the shaft clamping member in the roll supplying shaft direction; and providing a load to the roll supplying shaft for resisting the feeding movement of the print sheet and also feeding the print sheet to a transfer route; and feeding the print sheet in a strip-form along the transfer route toward the sheet printing unit.

6. A printer for a print sheet comprising:

a printer main body, the printer main body having a sheet supplying unit which holds a strip-form print sheet in a roll for enabling printing on the sheet a predefined information at a sheet printing unit, the sheet supply unit feeds the print sheet in a strip-form along a transfer route headed toward the sheet printing unit, and an openable cover connected to the printer main body at an opening and closing shaft toward one end portion of the main body, a roll holding member holding the print sheet in a roll and having a roll supplying shaft protruding respectively at a pair of right and left outer surfaces at the sheet supplying unit;

a shaft clamping member residing on a regulating plate within the printer main body and oriented along the attaching and detaching direction of the print sheet to and from the sheet supplying unit, and configured for clamping the sheet roll supplying shaft in an attachable and detachable manner; and an urging member urging the shaft clamping member towards the roll supplying shaft direction and for providing load to the roll supplying shaft for resisting the feeding movement of the print sheet; and the cover from the printer main body being operable to form a loading opening between the openable cover and the printer main body, and the shaft clamping member being positioned along the attaching and detaching direction from the loading opening to the sheet supplying unit of the rolled print sheet.

* * * * *